US005474301A

United States Patent [19]

Wilson

[11] Patent Number: 5,474,301

[45] Date of Patent: Dec. 12, 1995

[54] FIELD MARKERS

[76] Inventor: Porter C. Wilson, Box 35550, Tucson, Ariz. 85740-5550

[21] Appl. No.: 336,747

[22] Filed: Nov. 8, 1994

[51] Int. Cl.[6] ..... A63B 71/02

[52] U.S. Cl. ..... 273/411

[58] Field of Search ..... 273/411; 116/209

[56] References Cited

U.S. PATENT DOCUMENTS 4,991,536 2/1991 Moshofsky ..... 116/209

*Primary Examiner*—William H. Grieb

*Attorney, Agent, or Firm*—Millen, White, Zelano, & Branigan

[57] ABSTRACT

Spot markers for delineating areas used for athletic contests or games are configured as flat panels made of flexible material. Each panel includes a tongue and recess wherein the panel may be folded over and retained in a folded position by inserting the tongue into the recess. Each panel has a plurality of rectangular slots on opposite sides of a fold area into which extend rectangular flaps which are stiffened by stiffeners adhered thereto. When the markers are folded to form boundary markers, the flaps extend laterally to engage the ground so as to stabilize the boundary markers.

12 Claims, 3 Drawing Sheets

FIELD MARKERS

FIELD OF THE INVENTION

The present invention relates to field markers, and more particularly, the present invention relates to movable field markers which are especially useful as side line and end boundary markers used to set up fields of play for athletic fields, games and related activities.

BACKGROUND OF THE INVENTION

Many parks and open areas have flat fields which are suitable for games such as football, soccer, volleyball, flag football, etc., but have not been laid out for these activities. Accordingly, people using these fields for these purposes have resorted to markers of various types such as articles of clothing, sticks, rocks, etc. Lately, as such activities have become more organized, participants have utilized devices such as rubberized spots and cones wherein the spots are laid out at intervals to mark side lines and have used cones for field boundaries. Upon completing the activity, the rubberized spots and cones are collected and stored.

Cones have not proved particularly satisfactory because they consume considerable storage space and, even when made of relatively soft material, present projections which are capable of injuring players if run into. In addition, cones can be blown over by stiff winds, if not weighted down. However, weighing cones down increases the hazard to players because the cones present more formidable objects when run into.

Accordingly, there is a need for a new and improved system for spot marking a game in athletic areas wherein the disadvantages of cones can be avoided.

SUMMARY OF THE INVENTION

It is a feature of the present invention to provide new and improved markers for game areas, athletic fields and the like.

The present invention is directed to a spot marker for use in identifying side lines and boundaries of areas used for games and athletic contests. The spot marker comprises a panel of flexible material, a pair of recesses in a panel on opposite sides of a fold line, a tongue formed in the panel and a hole in the panel on the opposite side of the fold line, wherein the panel is folded about the fold line with the tongue inserted into the hole to provide a boundary marker.

In another aspect, the present invention is directed to an arrangement for marking a surface such as a field or hard surfaced area for athletic contests and games wherein the contests or games require side line markers as well as boundary markers. The arrangement comprises a plurality of panels which, when flat, provide side line markers and, when folded, provide boundary markers. Each panel is made of a flexible material and has a fastener thereon for retaining the panel folded when used as a boundary marker.

BRIEF DESCRIPTION OF THE DRAWINGS

Various other features and attendant advantages of the present invention will be more fully appreciated as the same becomes better understood when considered in conjunction with the accompanying drawings, in which like reference characters designate the same or similar parts throughout the several views, and wherein.

DETAILED DESCRIPTION OF THE PREFERRED EMBODIMENTS

Figure 1:
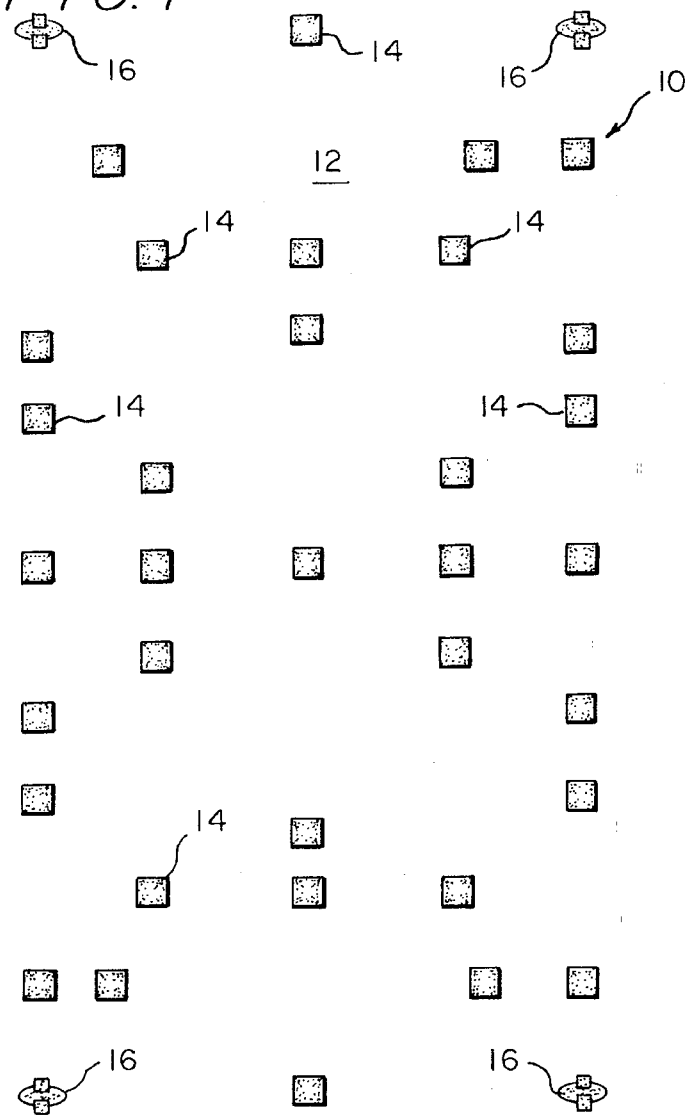
FIG. 1 is a planar view of a field area laid out as a flag football field.
Figure 5:
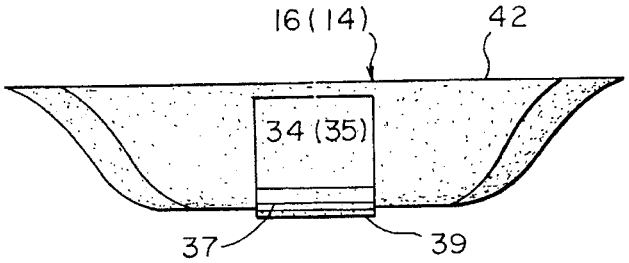
FIG. 5 is a side view of the spot marker of FIGS. 3 and 4 folded to provide a three dimensional boundary marker.
Figure 6:
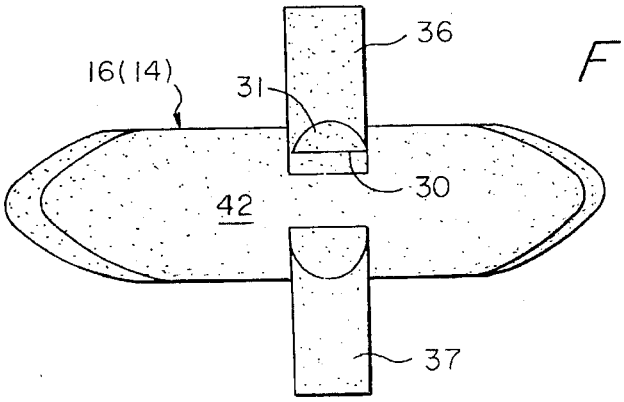
FIG. 6 is a top view showing the spot marker of FIGS. 3–5 folded to provide a three-dimensional boundary marker.
Figure 7:
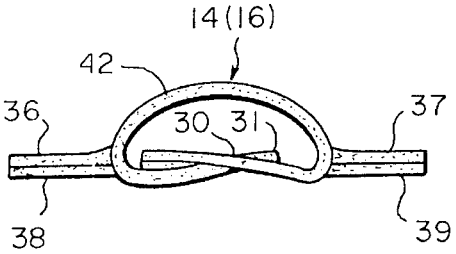
FIG. 7 is an end view of the folded marker of FIGS. 5 and 6.

Referring now to FIG. 1, there is shown a field 10 upon which a flag football field 12 has been delineated by a plurality of spot markers 14 configured as panels in accordance with the principles of the present invention. In FIG. 1, the spot markers 14 are the substantially square spot markers shown in FIGS. 3–6. To provide boundary markers 16, the spot markers are folded to provide height or a more three-dimensional appearance as is shown in FIGS. 5–7. The folded spot markers 14 which provide the boundary marker 16 replace conventional cones currently used as boundary markers for athletic fields and game areas.

Figure 2:
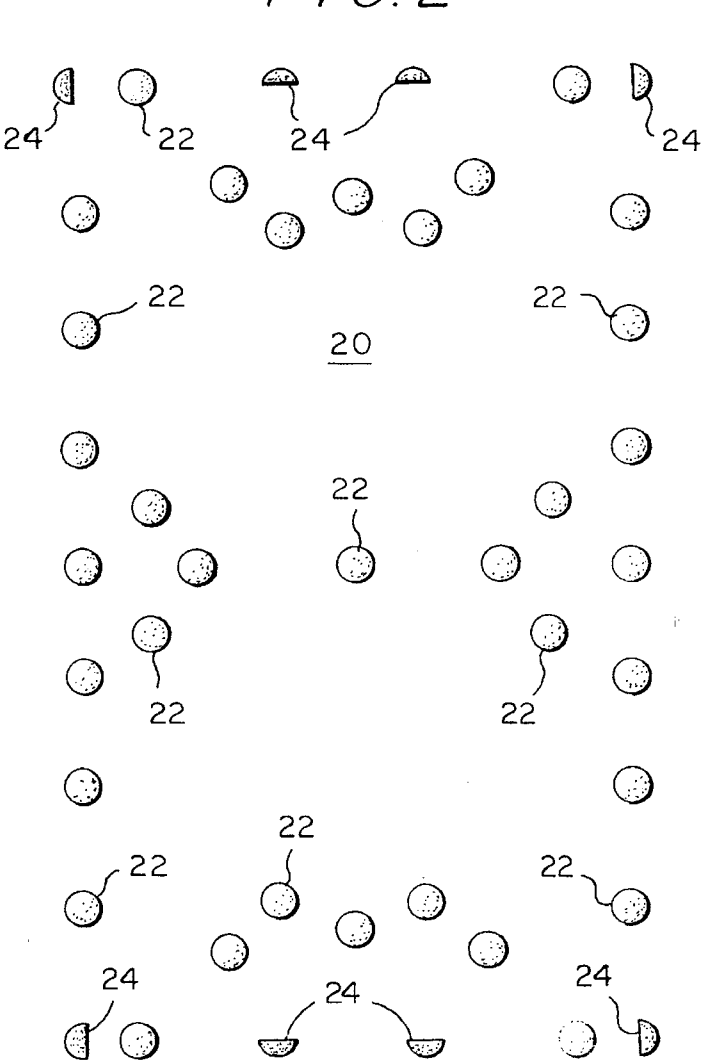
FIG. 2 is a planar view of a field area laid out as a soccer field.
Figure 8:
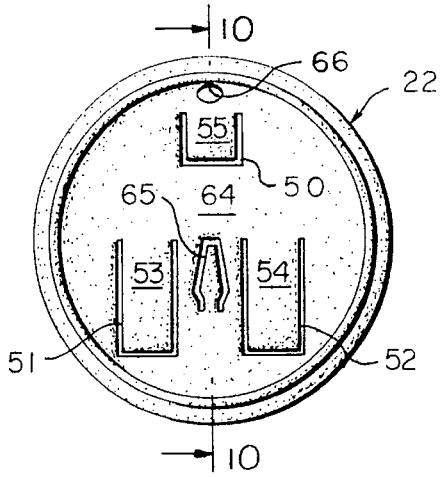
FIG. 8 is a top view of a second embodiment of a spot marker configured in accordance with the principles of the present invention.
Figure 10:
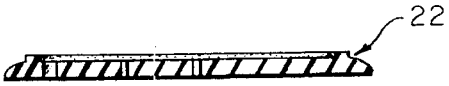
FIG. 10 is an elevation taken along lines 10—10 of FIG. 8.

Referring now to FIG. 2, there is shown a soccer field 20 delineated by the panels in the form of circular spot markers 22 of FIGS. 8 and 10 with boundary markers 24 configured by folding spot markers 22 to provide height. Again, the boundary markers 24 replace conventional cones utilized to delineate athletic fields and game areas.

Figure 3:
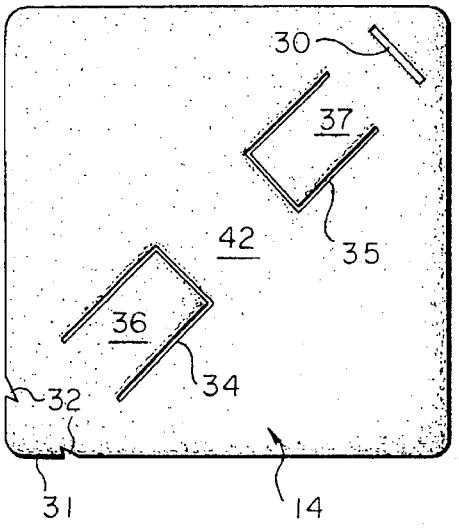
FIG. 3 is a top view of a spot marker configured in accordance with a first embodiment of the present invention.
Figure 4:
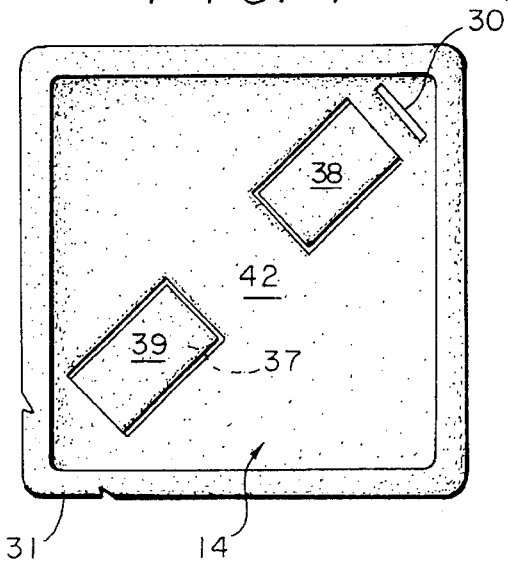
FIG. 4 is a bottom view of the spot marker of FIG. 3.

Referring now to FIGS. 3 and 4 where the spot marker 14 is shown, it is seen that the spot marker 14 is a substantially square panel when used with a number of other spot markers 14 to define a side line or the like. The spot marker 14 includes a slot 30 therein which receives a tongue 31 disposed at one corner of the spot marker, the tongue 31 being defined by a pair of opposed notches 32. When the spot marker is folded or rolled, the tongue 31 is received in the slot 30, as is seen in FIGS. 6 and 7.

The spot marker 14 is also provided with a pair of diagonally disposed recesses 34 and 35. Cantilevered from the outer edge of the recesses 34 and 35 are flaps 36 and 37 which are unitary with the remainder of the material comprising the rectangular spot marker. The underside of the flaps 36 and 37 are reinforced by stiffening panels 38 and 39 which underlie the flaps 36 and 37 but have a length longer than the flaps, providing portions 40 and 41 which are adhered to the bottom of the panel forming the spot marker 14.

Referring now to FIGS. 5-7, it is seen that the configuration of the spot marker 14 may be changed to provide a boundary marker 16 by folding or rolling generally at area 42 the spot marker 14 and tucking the tongue 31 in the slot 30. The boundary marker 16 has a tubular shape and a substantial vertical dimension so that it provides ready indication of boundaries on a playing field. By simply folding the spot marker 14 and tucking the tongue 31 in the slot 30, the configuration of the spot marker 14 is changed; consequently, there is no need for separate boundary markers which must be stored and transported differently from the spot markers which is the case with conventional spot and boundary markers. As is best seen in FIGS. 6 and 7, when the spot marker panel 14 is rolled with top surface on the outside of the tube 16, the flaps 36 and 37 stiffened by the stiffening panels 38 and 39 extend laterally and stabilize the boundary marker.

Figure 9:
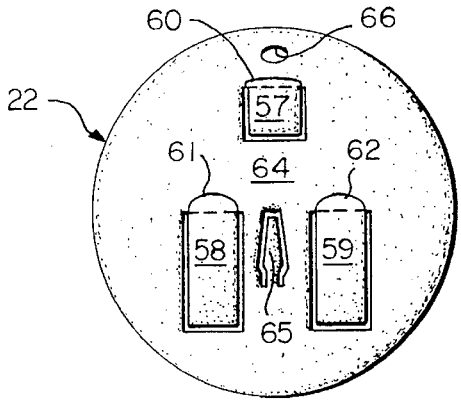
FIG. 9 is a bottom view of the spot marker of FIG. 8.

Referring now to FIGS. 8–10, there is shown in detail a second embodiment of the invention wherein the spot marker 22 is configured as a disk rather than a square. The spot marker 22 cooperates with other spot markers 22 to define side lines as is shown in FIG. 2. The spot marker 22 has three rectangular recesses 50, 51 and 52 into which project flaps 53, 54 and 55, respectively, the flaps being cantilevered from the material forming the disk 22. As with the rectangular spot marker 14, the spot marker 22 has reinforcing stiffeners 57, 58 and 59 adhered to and aligned with the flaps 53, 54 and 55 (see FIG. 9). The stiffeners 57, 58 and 59 each have portions 60, 61 and 62 which are adhered to and overlie the adjacent portions of the disk 22.

Figure 11:
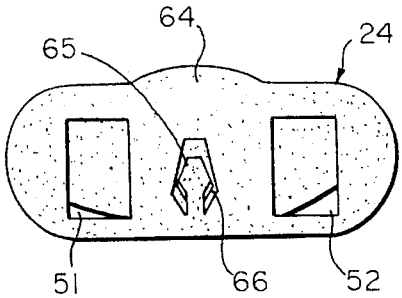
FIG. 11 is a side view showing the spot marker of FIGS. 8–10 folded to provide a three-dimensional boundary marker.
Figure 12:
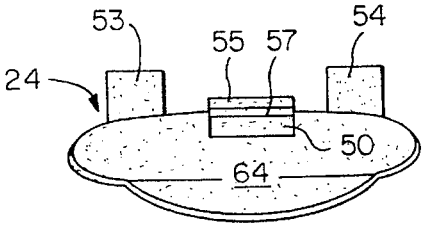
FIG. 12 is a top view of the folded marker of FIG. 11.
Figure 13:
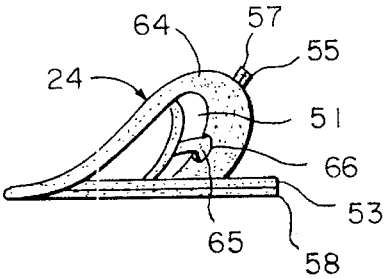
FIG. 13 is an end view of the three-dimensional boundary marker of FIGS. 11 and 12.

As is seen in FIGS. 11—13, the spot marker disk 22 may be folded over generally at area 64 and held in a folded position by inserting a tongue 65 into a circular hole 66 to retain the disk 22 folded so as to provide a boundary marker 24. The boundary marker 24 serves the same purpose as the boundary marker 16 of FIG. 3.

In their preferred embodiments, the spot marker 14 is a square having sides of about 1 ft. while the disk has a diameter of about 9 inches. Preferably, the disk and square are made of flexible polyurethane, polyethylene or a synthetic or natural rubber. The stiffeners 37–39 and 57–59 are made of a similar material but are relatively stiff compared to the flexible material. While in the illustrated embodiments of FIGS. 1 and 2, the spot markers 14 and 22 and boundary markers 16 and 24 are shown used on grass or soil fields, it is to be understood that these spot markers and boundary markers may also be used on wooden gymnasium floors, surfaced playground areas and the like.

From the foregoing description, one skilled in the art can easily ascertain the essential characteristics of this invention, and without departing from the spirit and scope thereof, can make various changes and modifications of the invention to adapt it to various usages and conditions.

What is claimed is:

1. A spot marker for use in identifying side lines and boundaries of areas used for games and athletic contests, the spot marker comprising:

a panel of flexible material for laying substantially flat to define a side line when used with other similar panels;

a pair of recesses in the panel on opposite sides of a fold area with cantilevered flaps extending therein for stabilizing the panel when the panel is folded;

a tongue formed in the panel on one side of the fold area; and a hole in the panel on the opposite side of the fold area from the tongue, wherein the panel is folded about the fold area with the tongue inserted into the hole to provide a boundary marker which cooperates with other boundary markers to define a boundary.

2. The spot marker of claim 1, wherein the panel is rectangular.

3. The spot marker of claim 1, wherein the panel is square.

4. The spot marker of claim 1, wherein the panel is circular.

5. The spot marker of claim 1, wherein the flaps have an underside and a top side; wherein the underside of each flap has a stiffener adhered thereto having dimensions no greater than the flap and having a portion adhered to the panel surface adjacent the flap and wherein, when the panel is folded to form a boundary marker, the flaps extend therefrom to help stabilize the boundary marker.

6. The spot marker of claim 5, wherein the panel is rectangular.

7. The spot marker of claim 5, wherein the panel is square.

8. The spot marker of claim 5, wherein the panel is circular.

9. An arrangement for marking a surface such as a field or hard surfaced area for athletic contests and games wherein the contests or games require side line markers as well as boundary markers, the arrangement comprising:

a plurality of panels which, when flat, provide side line markers and, when folded, provide boundary markers;

each panel being made of a flexible material and having a fastener thereon for retaining the panel folded when used as a boundary marker; and each panel has a plurality of recesses therein on opposite sides of a fold area wherein the recesses each have flaps cantilevered into the recesses from the panel, the flaps being unitary with the panel and stabilizing the panel with respect to the surface upon which the marker rests when folded to form a boundary marker.

10. The arrangement of claim 9, wherein stiffeners are affixed to each of the flaps, the stiffeners having portions fixed to the bottom surface of each panel,

11. The arrangement of claim 10, wherein the panels are square.

12. The arrangement of claim 10, wherein the panels are circular.

* * * * *